US010231532B2

(12) United States Patent
Barman

(10) Patent No.: US 10,231,532 B2
(45) **Date of Patent: *Mar. 19, 2019**

(54) CERVICAL SPINE AND HEAD SUPPORTING DEVICE

(71) Applicant: John Barman, Menlo Park, CA (US)

(72) Inventor: John Barman, Menlo Park, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/210,738

(22) Filed: Jul. 14, 2016

(65) Prior Publication Data

US 2016/0316893 A1 Nov. 3, 2016

Related U.S. Application Data

(63) Continuation of application No. 13/249,668, filed on Sep. 30, 2011, now Pat. No. 9,392,859.

(60) Provisional application No. 61/392,396, filed on Oct. 12, 2010.

(51) Int. Cl.

| | |
|---|---|
| ***A45D 44/10*** | (2006.01) |
| ***A47K 3/12*** | (2006.01) |
| ***A45D 19/08*** | (2006.01) |

(52) U.S. Cl.

CPC ..... *A45D 44/10* (2013.01); *A45D 19/08* (2013.01); *A47K 3/125* (2013.01)

(58) Field of Classification Search

CPC ..... A45D 44/10; A47K 3/125; A47C 16/02; A47C 16/025

USPC ..... 4/621

See application file for complete search history.

(56) References Cited

U.S. PATENT DOCUMENTS

| | | | | |
|---|---|---|---|---|
| 2,248,369 | A | 7/1941 | Ludersen | |
| 2,818,577 | A * | 1/1958 | Kubik | A47K 3/125 297/423.45 |
| 2,978,713 | A | 4/1961 | Scalzitti et al. | |
| 3,026,537 | A | 3/1962 | Schnell | |
| 3,363,620 | A | 1/1968 | Collins | |
| 3,480,973 | A * | 12/1969 | Stairs | A47C 3/0255 4/567 |
| 4,389,740 | A | 6/1983 | Henry | |
| 4,922,558 | A | 5/1990 | Porco | |
| 5,692,251 | A | 12/1997 | Page | |
| 5,862,542 | A | 1/1999 | Page | |
| 6,550,078 | B1 | 4/2003 | Brown et al. | |
| 2004/0070238 | A1 * | 4/2004 | Moser | A47K 3/282 297/183.9 |

* cited by examiner

*Primary Examiner* — Janie Loeppke
(74) *Attorney, Agent, or Firm* — Levine Bagade Han LLP

(57) ABSTRACT

A cervical spine and head supporting device is described herein for supporting a user's head when extended at least partially over the sink or basin. The device maintains alignment of the head with the neck or spine particularly as the user moves their head relative to the device or sink to prevent or minimize straining of the user's neck while washing their hair. The device generally comprises a base which is shaped for positioning within a sink or basin, a support column adjustable attached to the base, a supporting member extending from the support column, and a head support which is shaped to support a posterior region of a head of a user, where the head support is pivotably coupled to the supporting member such that the head support is adjustable with a movement of the head when the head is moved relative to the supporting member.

14 Claims, 7 Drawing Sheets

CERVICAL SPINE AND HEAD SUPPORTING DEVICE

CROSS-REFERENCE TO RELATED APPLICATIONS

This application is a continuation of U.S. patent application Ser. No. 13/249,668 filed Sep. 30, 2011 (now U.S. Pat. No. 9,392,859), which claims the benefit of priority to U.S. Provisional Application No. 61/392,396 filed Oct. 12, 2010, each of which is incorporated herein by reference in its entirety.

FIELD OF THE INVENTION

The present invention relates to methods and apparatus for adjustably supporting the head of a user when extended at least partially over a sink or basin as typically done when washing the user's hair, e.g., in a salon. More particularly, the present invention relates to methods and apparatus for supporting the user's head when extended at least partially over the sink or basin while maintaining alignment of the user's head with the spine particularly as the user moves their head relative to the apparatus.

BACKGROUND OF THE INVENTION

Consumers visit hair salons many times a year to get their hair cut. These visits typically include getting their hair washed prior to getting their hair colored, cut, and styled. While getting their hair washed, the customer's neck is stretched backward over the salon sink for ease of hair shampooing, conditioning and rinsing. This process is often repeated multiple times. The postural positioning that each customer endures for this hair washing process causes hyperextension of the neck without proper support at the hack of the head. The strain on the neck is increased when combined with rotation and side bending as the customer's head is being manipulated during the shampooing. The hair stylist or barber applies a mild compressive force while shampooing causing hyperextension of the neck. Some people can't tolerate the hyperextension of the neck and will experience discomfort and pain. This pain can last a long time if left untreated. Physicians are seeing patients complaining of neck pain with associated radicular pain in the upper limb as a result of injuries suffered in the salon while their hair is being shampooed. These injuries are often not reported or the root cause for the injury is not properly diagnosed. This neck pain along with the upper limb discomfort is simply known as "Cervical Radiculopathy" or "Salon Sink Radiculopathy". Less than 1% of the population experience Cervical Radiculopathy but it is on the rise. Treatment includes patient education to avoid obvious postures that exacerbate radicular symptoms and to assume positions that centralize discomfort. Treatments also include strong dosage of pain killers and steroids along with several weeks of physical therapy.

There are many devices like ALIGN-A-NECK® (Ideal Chiropractic Center, NJ) commercially available in the market to improve neck support during the shampooing process in the salon. However, these products fail to provide adequate support to the back of the head.

Additionally, numerous conventional devices are available yet each fail to provide for adjustability or flexibility (or both) for properly supporting the back of the head in the salon sink during the shampooing process.

SUMMARY OF THE INVENTION

A head support apparatus described herein for supporting a user's head when extended at least partially over the sink or basin may maintain alignment of the user's head with the spine particularly as the user moves their head relative to the apparatus or sink to prevent or minimize straining of the user's neck as well as to provide comfort while washing their hair. The head support apparatus may generally comprise a base which is shaped for positioning within a sink or basin, a support column slidably attached to the base such that a height of the column is adjustable relative to the base, a supporting member extending from the support column, and a head support which is shaped to support a posterior region of a head of a user, wherein the head support is pivotably coupled to the supporting member such that the head support is adjustable with a movement of the head when the head is moved relative to the supporting member. In some variations, the head support may be attached directly to a base while omitting an adjustable support column particularly where the device is used in shallow sinks.

During use, the user may have their head supported over the sink or basin by positioning the head support apparatus in proximity to the user's head where the head extends at least partially over a sink or basin, wherein the head support apparatus includes a base which is shaped for positioning within the sink or basin, supporting the posterior region of the user's head with the head support pivotably coupled to the supporting member extending from a support column which is slidably attached to the base, adjusting a height of the head support relative to the base such that the head is aligned with the spine of the user, and further adjusting a position of the head support relative to the base by pivotably adjusting the head support as the head is moved while maintaining alignment of the bead with the spine of the user.

Accordingly, the head support device provides a reusable device which is easy to clean and transferable from one sink to another. The head support may be pivotably coupled to the supporting member and also removably attached such that the head support may be removed from the device and a second head support may be attached in place. Additionally, the head support may define one or more openings through the support to allow for the drainage of water and fluids from the support. Moreover, because of the adjustable height, in addition to the pivotably adjustable head support, the user's head may be supported to align their head with their neck and/or spine even when the user moves or readjusts their position without losing support to eliminate or minimize cervical radiculopathy.

DETAILED DESCRIPTION OF THE INVENTION

Figure 1:
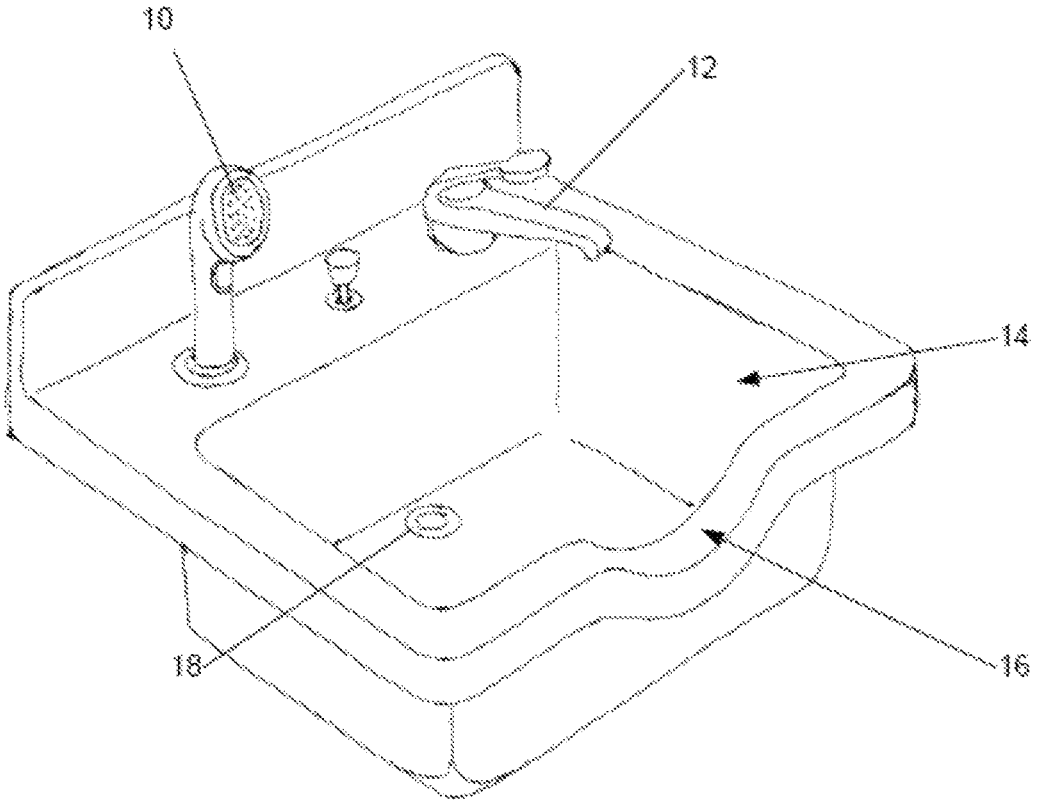
Fig. 1 PRIOR ART
FIG. 1 shows a perspective view of a conventional sink used in a salon for shampooing the hair.

A conventional sink or hair washing station in a salon is shown in the perspective view of FIG. 1 and generally has a sink or basin 14 with neck supporting structure 16, water faucet 12, a shower head 10 for washing the hair, and a drain 18. Typically a person who needs their hair shampooed sits on a chair in close proximity of the sink and bends the head backwards over the neck supporting structure 16 into the sink basin 14. Some salons have chairs that recline and tilt the person's head over the neck supporting structure 16 and into the basin 14. The hair stylist or the barber often supports the head with their palm to ease the strain on the person's neck, however, this is only temporary support. Typically the shampooing process could last anywhere from 5 minutes to 20 minutes. The strain on the neck is increased during the manipulation of the hair and washing process. The head supporting device disclosed here could be used in the basin 14 to support the person's head throughout the shampooing process thus minimizing the strain on the neck.

Figure 2A:
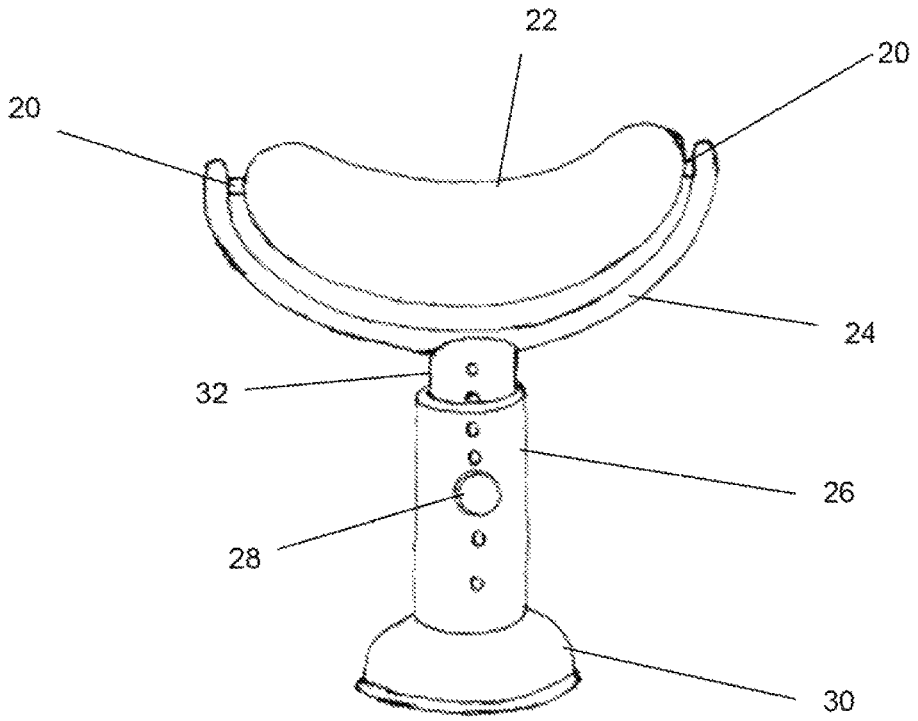
FIG. 2A shows a front view of one example of the adjustable head supporting device.
Figure 2B:
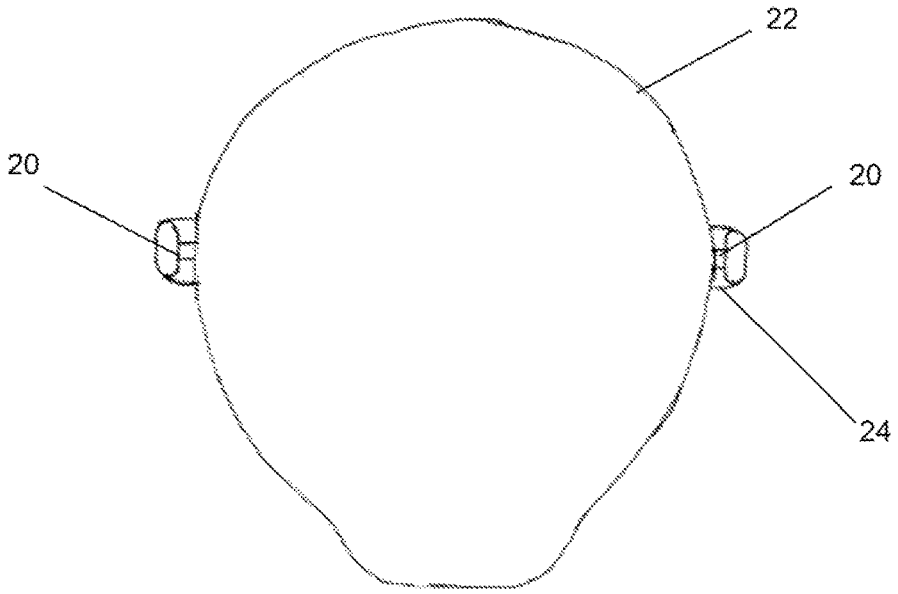
FIG. 2B shows a top view of one example of the adjustable head supporting device.

One example of a head supporting device is shown in the front and top views of FIG. 2A and FIG. 2B. Generally, head supporting device may comprise a base 30 which is shaped for positioning within a sink or basin, a support column 26 which is attached to the base 30 and through which a telescoping support 32 is slidably coupled such that a height of the column 26 is adjustable relative to the base 30, a supporting member 24 extending from the support column 26, and a head support 22 which is shaped to support a posterior region of a head of a user. The base 30 may comprise a molded plastic structure that gives stability to the device and plastics used to fabricate the base include Polyethylene, ABS, Nylon or Kynar. In one example, the base 30 may be formed as a supporting structure configured, e.g., as two or more supporting arms which extend to provide for a stable support upon the bottom of the sink or basin while allowing for clearance beneath the device to facilitate drainage of water or shampoo. Alternatively, the base 30 may comprise a suction-type support structure which may be adhered temporarily to the bottom of the sink or basin. Such a suction cup base may be fabricated from rubber materials like EPDM, silicone or Polyurethane.

The telescoping support 32 may be slidable relative to the support column 26 and base 30 and locked in position via a lock mechanism, e.g., a locking pin or knob, to adjust a position of the head support 22 under the user's head when the head is extended over the neck supporting structure 16. The adjustable support column 26 can be two telescoping metal tubes made out of steel, brass or other suitable metallic material and that have slots along the length for height adjustment. Desired heights can be set by sliding the column and locking the position by inserting, e.g., the locking pin or knob 28 into the slot. In this manner, the weight of the user's head may be supported entirely or at least partially by the head support 22 such that the neck is unstrained by having to rest upon the neck supporting structure and supporting the user's head. Moreover, the various structures of the supporting structure may be made from various materials aside from steel, such as brass, cast iron, etc., which are sufficiently strong enough to support a user's head during use. Additionally, the structures may also be coated or covered with various materials, e.g., nickel plating, chrome plating, powder coating and/or paint, to prevent corrosion.

The head support 22 is pivotably coupled via swivels 20 to the supporting member 24 such that the head support 22 is adjustable with a movement of the head when the head is moved relative to the supporting member 24. The supporting member 24 may be attached integrally or removably to the telescoping support 32 and/or support column 26 such that the supporting member 24 extends in a curved, or arcuate manner into a yoke, as shown, for attachment to the head support 22. The example illustrates two opposed pivots or swivels 20 rotatingly attached to either side of the head support 22 to allow for the free pivoting motion of the support 22 relative to the supporting member 24 and base 30. Alternatively, the supporting member 24 may be attached at a single location along the head support 22 provided that the attachment allows for the pivoting adjustable movement between the structures.

Additionally and/or alternatively, to provide increased support to the column 26, additional side arms may be included that rest on the edges of the sink where the length of the side arms can be adjusted in a similar manner as the column height.

The head support 22 may be configured as a cushion such as a hydrophobic foam structure that conforms to the person's head. The cushion may have a concave, soft conformable top surface for supporting the back of the head and a rigid outer shell to provide structural rigidity. The outer shell can be of a sheet metal or molded plastics, e.g., Polyethylene, Nylon, Kynar or ABS. The swivel joint 20 can be made, in one example, by having balls at the cushion ends and sockets at the ends of the supporting member 24. The supporting arm may be made out of, e.g., steel, brass or other suitable material and is connected to the adjustable column post 26.

The hydrophobic foam can be either, e.g., silicone rubber, polyurethane or EPDM rubber. The material chosen to make the cushion is able to withstand the wet environment, warm water, shampoo and other chemicals used in the salon industry. The cushion is also able to withstand disinfecting cleaning agents and detergents. The swivel joints 20, supporting member 24 and adjustable column 26 are also able to survive the salon's harsh environment while supporting the weight of a person's head.

Additionally and/or alternatively, the head support 22 may have through one or more holes or perforations to allow for the water to run down into the sink or basin easily during the shampooing process. Moreover, the head support 22 can be covered with a thin plastic bag or cover that can be disposed after each use to prevent the cushion from getting wet and to prevent any cross contamination. Moreover, the head support 22 may be removably coupled to the supporting member 24 such that a second head support may be attached in place.

Figure 3A:
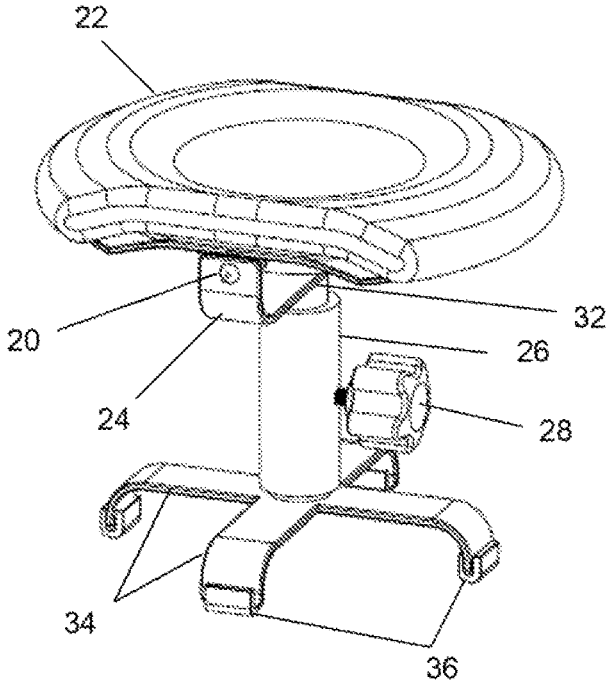
FIG. 3A shows a perspective view of another example of the device having an alternative base.
Figure 3B:
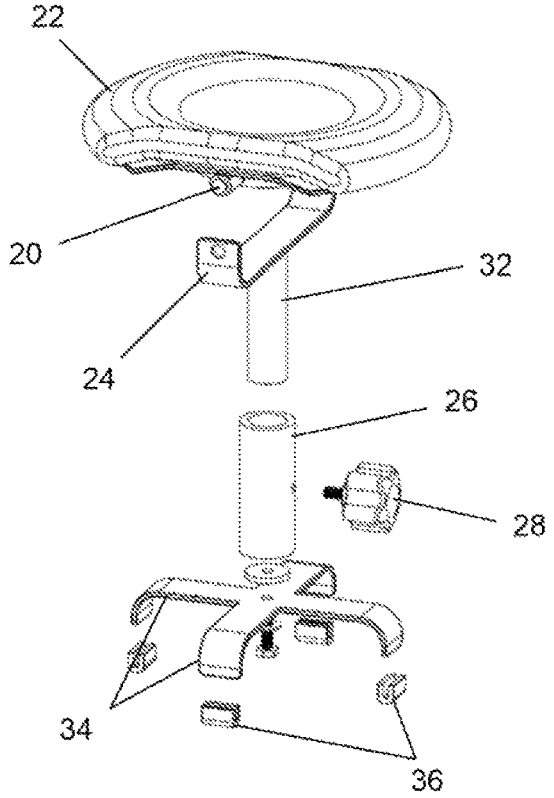
FIG. 3B shows an exploded assembly view of the device of FIG. 3A.

As mentioned above, the base 30 may be formed as a supporting structure configured, e.g., as two or more supporting arms which extend to provide for a stable support upon the bottom of the sink or basin. As shown in the perspective and exploded assembly views of FIGS. 3A and 3B, another example is illustrated where the base 30 is configured as four supporting arms 34 extending radially and at an angle relative to the support column 26. The supporting arms 34 are illustrated as four uniformly spaced arms but may comprise as few as two or more than four depending upon the desired configuration of the device as well as the configuration of the sink or basin into which the device may be positioned. Moreover, two of the opposing arms may be shortened in length relative to the remaining two opposed arms to accommodate positioning of the arms 34 in proximity to the walls of the sink or basin. Additionally, each of the arms 34 may further comprise a pad or bumper 36 (any soft or compliant material, e.g., rubber, silicone, etc.) which may be integrally or removably secured upon the ends of each arm 34 for contacting against the sink or basin to provide protection against damaging the sink or basin as well as to optionally increase the frictional resistance against movement of the arms 34 relative to the sink or basin when in use.

Figure 4:
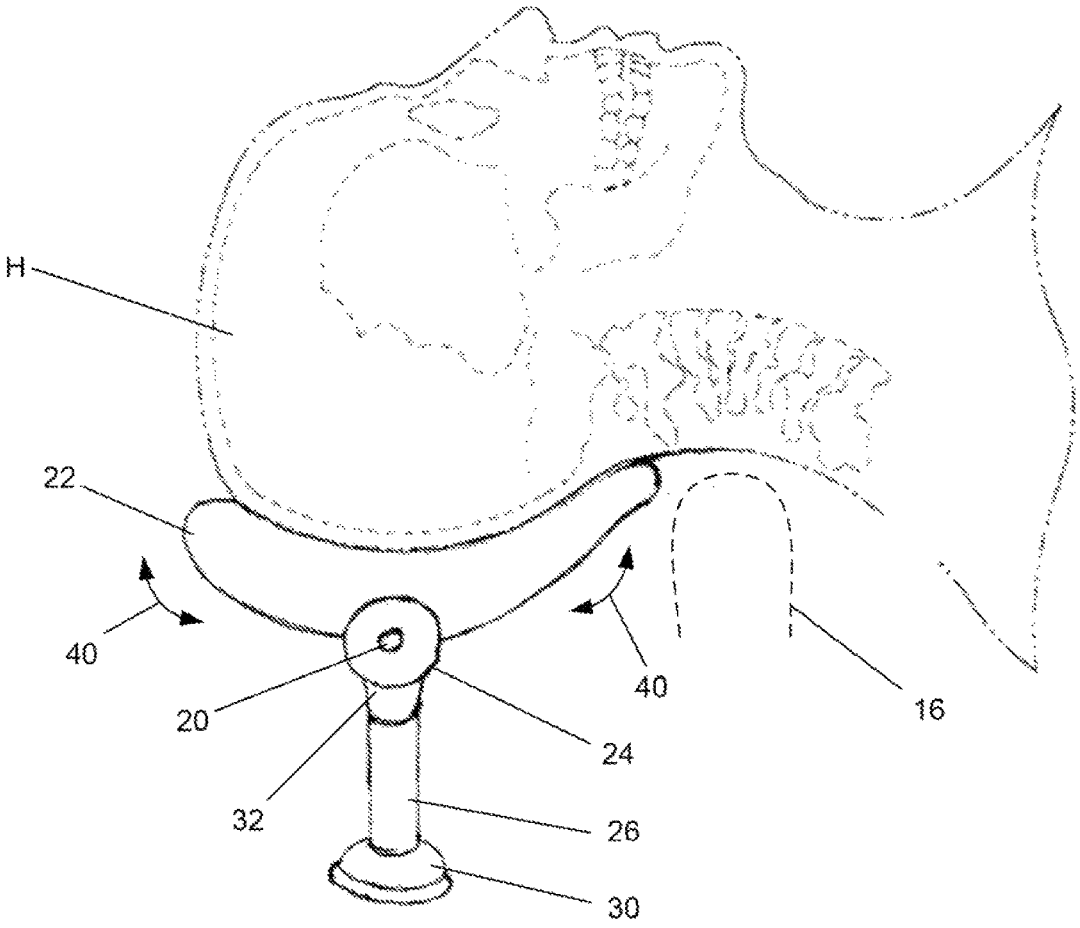
FIG. 4 shows a side view of the adjustable head supporting device showing a head supported by the device such that the user's head is aligned with their neck and/or spine.

FIG. 4 illustrates a side view of the adjustable head supporting device showing a user's head H supported by the device such that the user's head H is aligned with their neck and/or spine. The entire weight or partial weight of the head H may be supported by the head support 22 such that the user's neck does not rest upon the neck supporting structure 16 or rests only partially upon the structure 16 to prevent any strain to the user's neck. Moreover, with the head support 22 pivotably attached to the supporting member 24 via the one or more swivel joints 20, the user may freely adjust a position of their head for comfort, while having their head H supported over the sink by having the head support 22 move or pivot relative to the base 30 by pivotably adjusting the head support 22 as the head H is moved, as indicated by the direction of motion 40 of the head support 22. Having such adjustability allows for support of the head H in a manner which maintains alignment of the head H with the neck or spine of the user.

Figure 5:
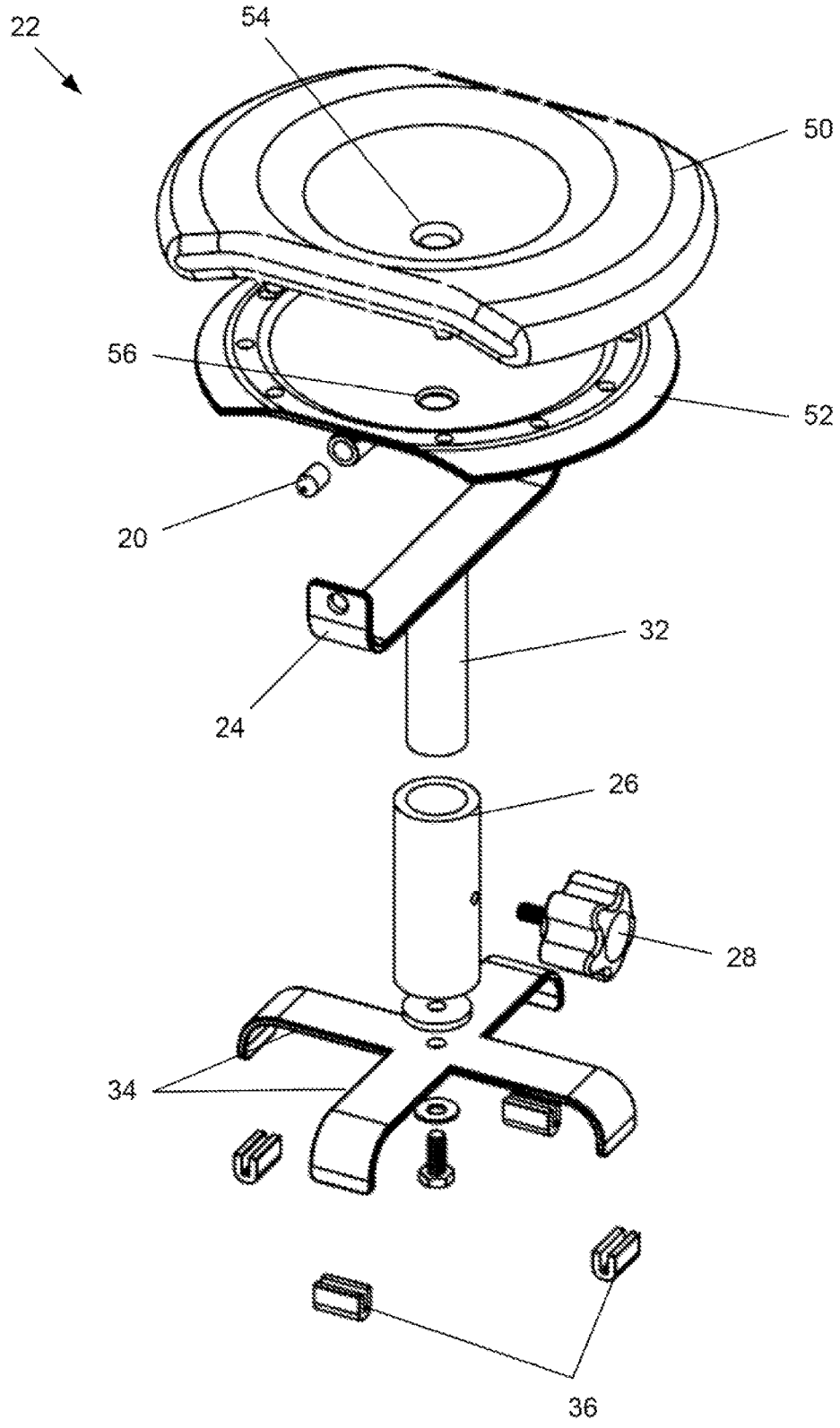
FIG. 5 shows an exploded assembly view of another variation of the supporting structure where the head support may be configured with an opening to allow for drainage from the cushion.

FIG. 5 illustrates a perspective and exploded assembly view of another variation of the supporting structure where the head support 22 may be configured with an opening defined through the head support 22 to allow for the drainage of water and other fluids during use. In this variation, the cushion 50 may be formed as a separate support which is optionally contoured for a user's head and which may mounted on a supporting cushion base 52. The cushion base 52 may be formed from a molded plastic, e.g., ABS, Nylon, PEEK, etc., or it may be alternatively formed from a sheet metal, e.g., brass, steel, cast iron, etc. The cushion 50 itself may be removably attached to the cushion base 52 via any number of attachment mechanisms to allow for the removal and reattachment of the cushion 50 to the base 52 while the base 52 may remain attached to the assembly, such as via the pivots 20 as illustrated.

Both the cushion 50 and cushion base 52 may form one or more openings 54, 56 in an aligned orientation when the cushion 50 is attached to the cushion base 52 during use. The openings 54, 56 may function as a drain to allow for the passage of water and other fluids from atop the cushion 50 to the underlying drain below during use and to further prevent the pooling of fluids for increased comfort.

Figure 6:
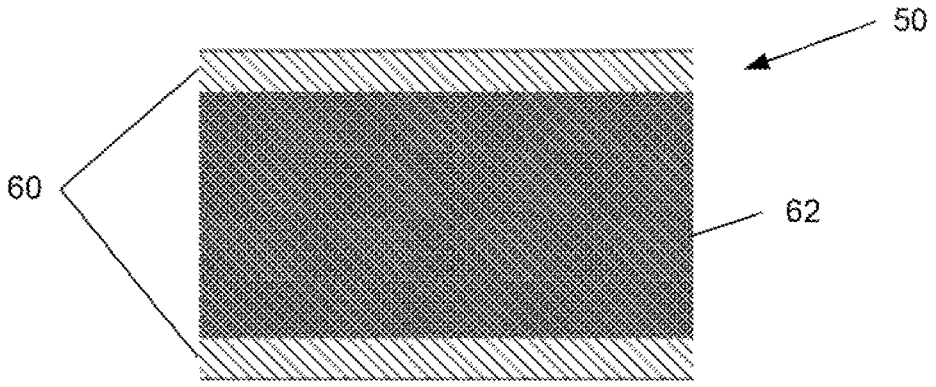
FIG. 6 shows a cross-sectional side view of one example of a foam cushion surrounded by an outer sealing layer.

FIG. 6 shows a cross-sectional side view in one example of the cushion 50 which may be formed of a foam layer 62 surrounded by an outer sealing layer 60. The foam layer 62 may be a highly flexible open cell layer made out of various suitable materials, e.g., silicone, polyurethane, latex, polyethylene, etc. Additionally, the sealing layer 60 surrounding the foam layer 62 may be a water-resistant material fabricated from any number of suitable materials, e.g., silicone rubber, polyurethane, styrene-butadiene co-polymer latex (SBR), or other rubbers or flexible plastics.

Figure 7:
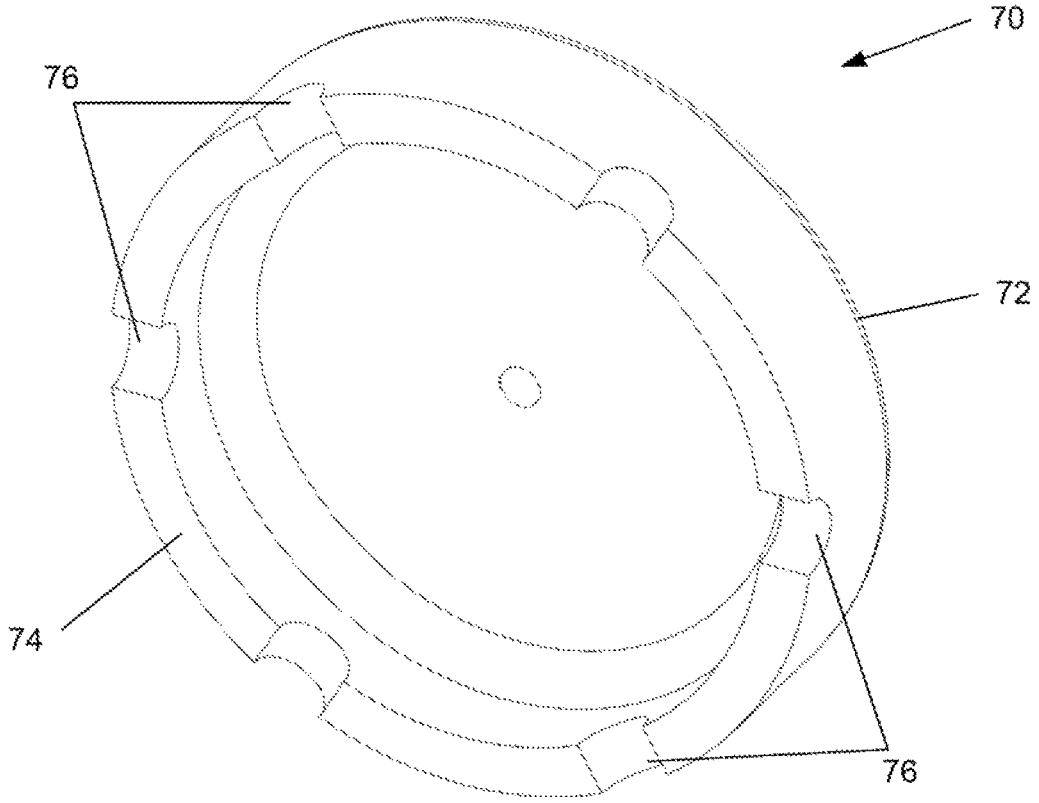
FIG. 7 shows a perspective view of the bottom of a base having one or more holes to facilitate drainage of water and other fluids through the base.

Aside from the cushion, the base itself may also be configured into alternative arrangements. An example is illustrated in the perspective view of FIG. 7 which shows a perspective view of the bottom of a base 70 having one or more holes to facilitate drainage of water and other fluids through the base 70 which may be fabricated from any number of suitable materials (e.g., ABS, PC, Nylon, PEEK, etc.). In this variation, the base 70 may be configured into a support 72, such as a circularly shaped structure, having a wall 74 projecting around the periphery of the support 72. The wall 74 may define one or more openings 76 which extend through the base wall 74 to allow for the free passage of water and other fluids to drain through the base 70 and into the sink drain. Although the openings 76 are illustrated as having a uniform arrangement around the periphery of the wall 74, the number of openings 76 may be varied as well as the arrangement of the openings 76.

Moreover, the support 72 may be configured into any number of other shapes (e.g., elliptical, square, triangular, etc.) depending upon the desired configuration and the base 70 may be optionally and removably attachable to allow for the replacement or swapping out of the base 70 with any number of other base configurations, such as base 30 or the base configured with multiple supporting arms 34 described above.

Figure 8:
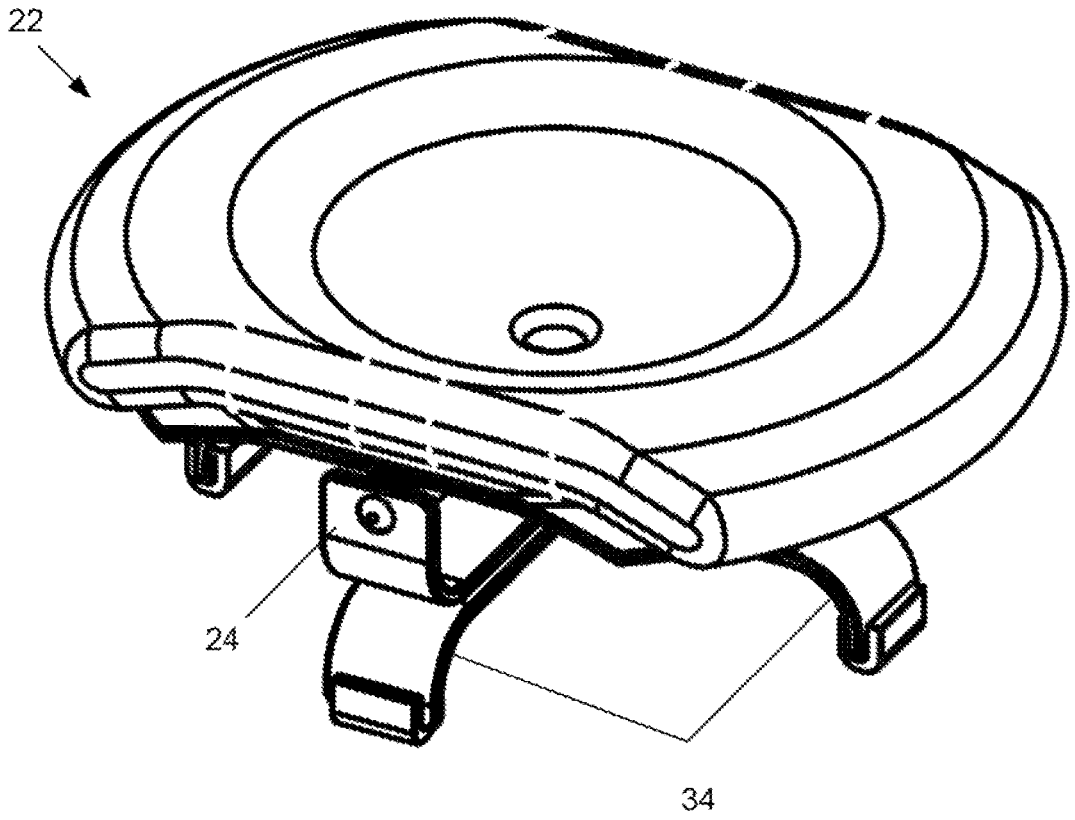
FIG. 8 shows a perspective view of another variation of a head support attached directly to a base.

In yet another variation, the supporting structure may be configured with the head support 22 pivotably (or non-pivotably) attached directly to the base, as shown in the perspective view of FIG. 8. In this variation, the intervening structures such as a support column 26 or telescoping support 32 may be omitted to allow for the supporting structure to be positioned comfortably in sinks which are shallow, such as bowl-like sinks, where minimal height adjustment is needed, if at all.

The applications of the devices and methods discussed above are not limited to use within a salon environment but may include any number of further applications. Modification of the above-described assemblies and methods for carrying out the invention, combinations between different variations as practicable, and variations of aspects of the invention that are obvious to those of skill in the art are intended to be within the scope of the claims.

What is claimed is:

1. A head support apparatus, comprising:

a base which is shaped for positioning within a sink or basin;

a support column attached to the base;

a supporting member extending from and removably attached to the support column; and a head support comprising a concave top surface with a drainage opening, wherein the head support is pivotably coupled to the supporting member via joints positioned on both sides of the head support such that the head support remains angularly adjustable with a movement of the head when the head is moved relative to the supporting member, and wherein the head support apparatus is configured to remain unconstrained to the sink or basin.

2. The apparatus of claim 1 wherein the head support comprises a circularly concave top surface with a fully encircled drainage opening at a low-point of a cross-sectional height of the circularly concave top surface.

3. The apparatus of claim 2, wherein the fully encircled drainage opening is substantially circular.

4. The apparatus of claim 1 wherein the base is shaped for temporary securement to the sink or basin.

5. The apparatus of claim 1 wherein the supporting member comprises a tubular member which fits within the support column and the supporting member is adjustably translatable relative to the base.

6. The apparatus of claim 5 wherein the supporting member further comprises a yoke portion and the yoke portion comprises raised lateral sides, wherein the head support is pivotably coupled to the raised lateral sides of the yoke portion via the joints.

7. The apparatus of claim 1 wherein the head support comprises a cushion and a cushion base, wherein the cushion base is pivotably coupled to the supporting member via the joints, and wherein a portion of the cushion is concentrically concave.

8. The apparatus of claim 1 wherein the head support is removably coupled to the supporting member.

9. The apparatus of claim 1 further comprising a locking mechanism configured to prevent movement between the support column and the support member.

10. The apparatus of claim 1 wherein the head support is adjustable in height relative to the base.

11. The apparatus of claim 1, wherein the base comprises four supporting arms extending from the base.

12. The apparatus of claim 11, wherein the four supporting arms curve downward away from the head support.

13. The apparatus of claim 1, wherein a portion of the concave top surface of the head support is concentrically concave in a funnel shape such that a radially inner surface of the concave top surface is positioned lower than a radially outer surface of the concave top surface.

14. The apparatus of claim 1, wherein the joints comprise a first joint and a second joint and the first joint is positioned on one side of the drainage opening and the second joint is positioned on another side of the drainage opening.

* * * * *